US011679586B2

(12) United States Patent
Kanzaki et al.

(10) Patent No.: US 11,679,586 B2
(45) Date of Patent: Jun. 20, 2023

(54) LIQUID DISCHARGE HEAD

(71) Applicant: BROTHER KOGYO KABUSHIKI KAISHA, Nagoya (JP)

(72) Inventors: Shotaro Kanzaki, Handa (JP); Toru Kakiuchi, Chita (JP); Takaaki Yoshino, Nagoya (JP); Taisuke Mizuno, Yokkaichi (JP); Jiro Yamamoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 79 days.

(21) Appl. No.: 17/483,345

(22) Filed: Sep. 23, 2021

(65) Prior Publication Data

US 2022/0126578 A1 Apr. 28, 2022

(30) Foreign Application Priority Data

Oct. 27, 2020 (JP) ..... JP2020-179934

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2002/14225; B41J 2002/14459; B41J 2/14209; B41J 2202/12
See application file for complete search history.

(56) References Cited

U.S. PATENT DOCUMENTS 8,807,719 B2 * 8/2014 Hoisington ..... B41J 2/175 347/85
2020/0307197 A1 10/2020 Hirai et al.

FOREIGN PATENT DOCUMENTS

JP 2008-290292 A 12/2008
JP 2020-168853 A 10/2020

OTHER PUBLICATIONS

IP.com search (Year: 2023).*

* cited by examiner

*Primary Examiner* — Lisa Solomon
(74) *Attorney, Agent, or Firm* — Kenealy Vaidya LLP

(57) ABSTRACT

There is provided a liquid discharge head including: a plurality of first individual channels; a first supply manifold; a first return manifold; a plurality of second individual channels; a second supply manifold; a second return manifold; and a first bypass channel communicating the first supply manifold and the second return manifold. The first bypass channel includes: a first supply connecting channel, a first return connecting channel, and a first connecting channel. Channel resistance in one of the first supply connecting channel and the first return connecting channel is greater than channel resistance in the first connecting channel.

10 Claims, 8 Drawing Sheets

LIQUID DISCHARGE HEAD

CROSS REFERENCE TO RELATED APPLICATIONS

The present application claims priority from Japanese Patent Application No. 2020-179934, filed on Oct. 27, 2020, the disclosure of which is incorporated herein by reference in its entirety.

BACKGROUND

There is a known configuration which is provided with a supply manifold and a return manifold and in which an ink is circulated between an ink tank and a liquid discharge head, with suppression of increase in the viscosity of the ink inside a nozzle as a purpose of the configuration.

A conventionally known liquid discharge head has a bypass channel communicating a supply manifold and a return manifold configured to have a two-story structure with each other. Owing to such a configuration, air can be exhausted from a downstream end of the supply manifold to the return manifold. Such a bypass channel is arranged to be away from each of individual channels, and includes a part extending from the downstream end of the supply manifold on an extension line of the supply manifold, and a part communicating the supply manifold and the return manifold with each other.

SUMMARY

However, there is such a fear that in a case that the bypass channel is constructed of a plurality of etching plates, any deviation in adhering the plurality of etching plates might cause the channel resistance in the bypass channel to change, which in turn might lead to such a situation that the ink cannot be made to flow in a desired flow amount.

In view of the situation as described above, an object of the present disclosure is to provide a liquid discharge head capable of allowing the liquid to flow from the supply manifold toward the return manifold in a desired flow amount, even in a case that any deviation in the adhesion among the plurality of plates occurs.

A liquid discharge head according to an aspect of the present disclosure includes: a plurality of first individual channels; a first supply manifold; a first return manifold; a plurality of second individual channels; a second supply manifold; a second return manifold; and a first bypass channel. Each of the plurality of first individual channels includes a first nozzle. The first supply manifold is connected to the plurality of first individual channels and is configured to supply a liquid to the plurality of first individual channels. The first return manifold is connected to the plurality of first individual channels and is configured to cause the liquid not discharged from the first nozzle to flow therein. Each of the plurality of second individual channels includes a second nozzle. The second supply manifold is connected to the plurality of second individual channels and is configured to supply the liquid to the plurality of second individual channels. The second return manifold is connected to the plurality of second individual channels and is configured to cause the liquid not discharged from the second nozzle to flow therein. The first bypass channel communicates the first supply manifold and the second return manifold. The first bypass channel includes: a first supply connecting channel connected to the first supply manifold, a first return connecting channel connected to the second return manifold, and a first connecting channel communicating the first supply connecting channel and the first return connecting channel. Channel resistance in one of the first supply connecting channel and the first return connecting channel is greater than channel resistance in the first connecting channel.

The channel resistance in one of the first supply connecting channel and the first return connecting channel is greater than the channel resistance in the first connecting channel. Accordingly, it is possible to make the difference in the channel resistance in the entirety of the first bypass channel to be substantially absent, even in a case that any deviation in the adhesion among the plates occurs and that a part of the first connecting channel is clogged. With this, it is possible to allow the liquid to flow from the supply manifold toward the return manifold in the desired flow amount.

With this, it is possible to provide a liquid discharge head capable of allowing the liquid to flow from the supply manifold toward the return manifold in a desired flow amount, even in a case that any deviation in the adhesion among the plurality of plates occurs.

DETAILED DESCRIPTION

In the following, a liquid discharge head of the present disclosure will be explained, with reference to the drawings. The liquid discharge head explained in the following is merely an embodiment of the present disclosure. Accordingly, the present disclosure is not limited to or restricted by the following embodiment; any addition, deletion and/or change are/is possible within the range not departing from the gist and spirit of the present disclosure.

<Configuration of Liquid Discharge Apparatus>

Figure 1:
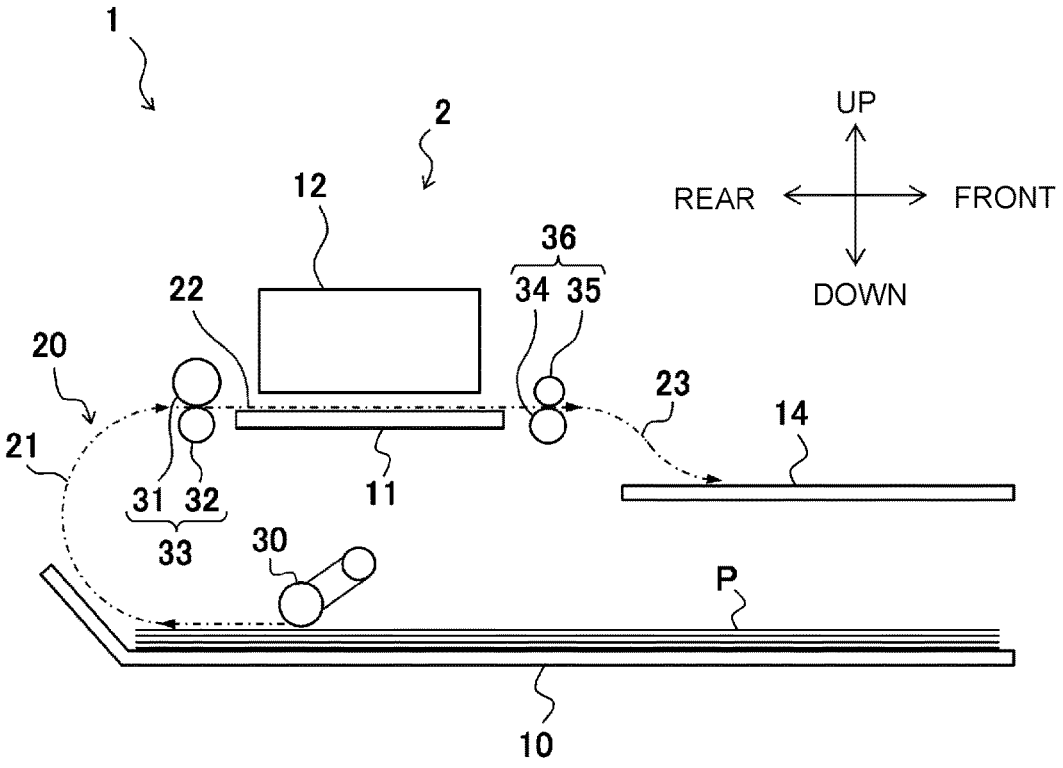
FIG. 1 is a view schematically depicting the overall configuration of a liquid discharge apparatus.

As depicted in FIG. 1, a liquid discharge apparatus 1 includes a paper feed tray 10, a platen 11 and a line head 12 which are arranged in this order from below. The paper feed tray 10 accommodates a plurality of pieces of a sheet P. The platen 11 which is long in an orthogonal direction orthogonal to the sheet surface of FIG. 1 is provided at a location above the paper feed tray 10. The platen 11 is a plate-shaped member and supports the sheet P, which is being conveyed, from therebelow. The line head 12 is provided further at a location above the platen 11. A plurality of liquid discharge heads 13 are provided on the line head 12. Further, a paper discharge tray 14 is provided at a location in front of the platen 11; the paper discharge tray 14 receives the sheet P after recording has been performed thereon.

A sheet conveying route 20 is extended from a location on the rear side of the paper feed tray 10. The sheet conveying route 20 links or connects the paper feed tray 10 to the paper discharge tray 14. The sheet conveying route 20 can be divided into three paths which are: a curved path 21, a straight path 22 and an end path 23. The curved path 21 is curved upward from the paper feed tray 10, and reaches to the vicinity of a rear side of the platen 11. The straight path 22 extends from an end point of the curved path 21 and reaches to the vicinity of front side of the platen 11. The end path 23 extends from an end point of the straight path 22 and reaches up to the paper discharge tray 14.

The liquid discharge apparatus 1 is provided with, as a conveyer configure to convey the sheet P, a feeding roller 30, a conveying roller 31 and a discharging roller 34. The conveyer conveys the sheet P in the paper feed tray 10 up to the paper discharge tray 14 along the sheet conveying route 20.

Specifically, the feeding roller 30 is provided at a location above the paper feed tray 10 and makes contact with the sheet P from thereabove. The conveying roller 31 is combined with a pinch roller 32 to thereby construct a conveying roller part 33, and is arranged in the vicinity of a downstream end of the curved path 21. The conveying roller part 33 links or connects the curved path 21 and the straight path 22. The discharging roller 34 is combined with a spur roller 35 to thereby construct a discharging roller part 36, and is arranged in the vicinity of a downstream end of the straight path 22. The discharging roller part 36 links or connects the straight path 22 and the end path 23.

Here, the sheet P is supplied to the conveying roller part 33 by the feeding roller 30 via the curved path 21. Further, the sheet P is fed from the straight path 22 to the discharging roller part 36 by the conveying roller part 33. In the straight path 22, a liquid such as an ink, etc., is discharged or ejected from the liquid discharge heads 13 with respect to the sheet P on the platen 11. An image is recorded on the sheet P. The sheet P on which the recording has been performed is conveyed by the discharging roller part 36 up to the paper discharge tray 14.

Figure 2:
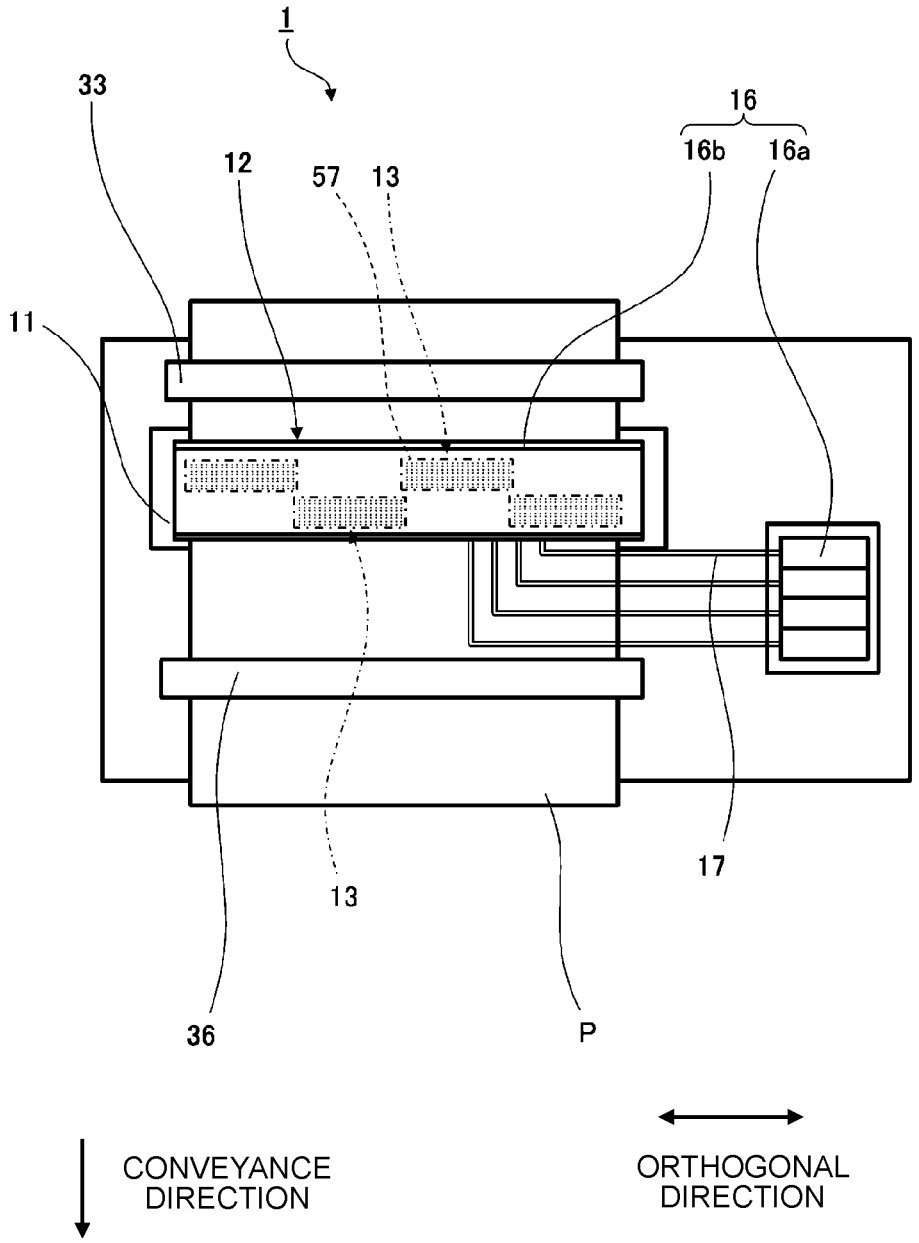
FIG. 2 is a schematic view depicting the overall configuration of the liquid discharge apparatus, as seen in a plane view from thereabove.
Figure 3A:
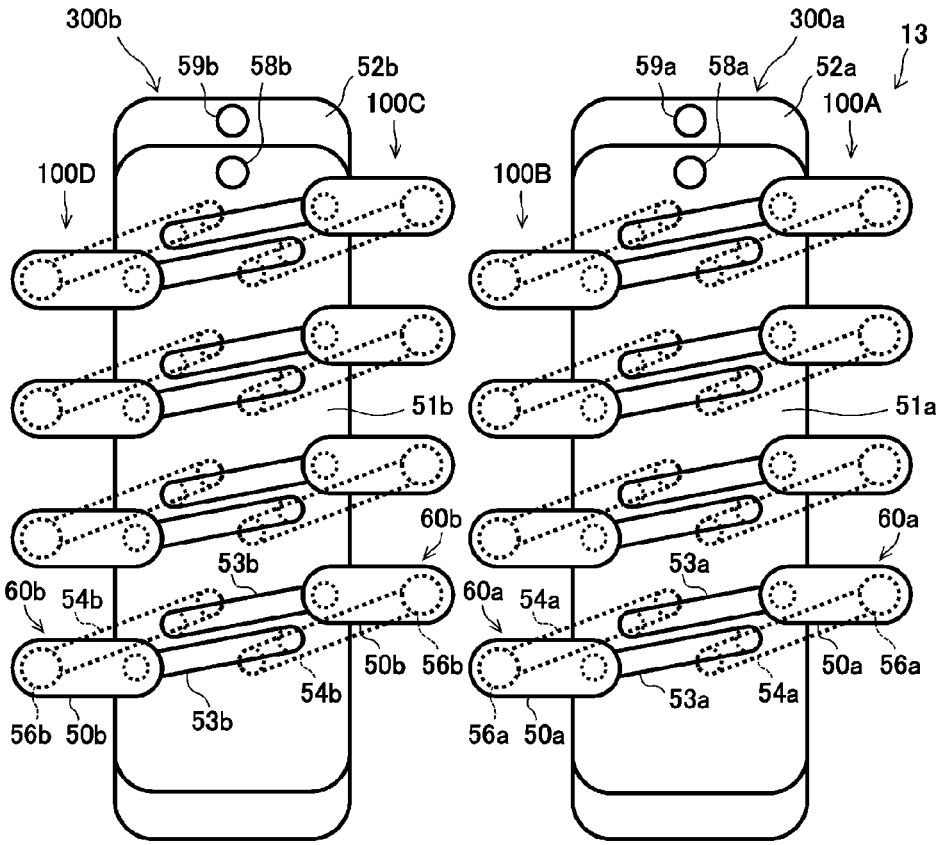
FIG. 3A is a schematic view depicting the plane configuration of the liquid discharge head.
Figure 3B:
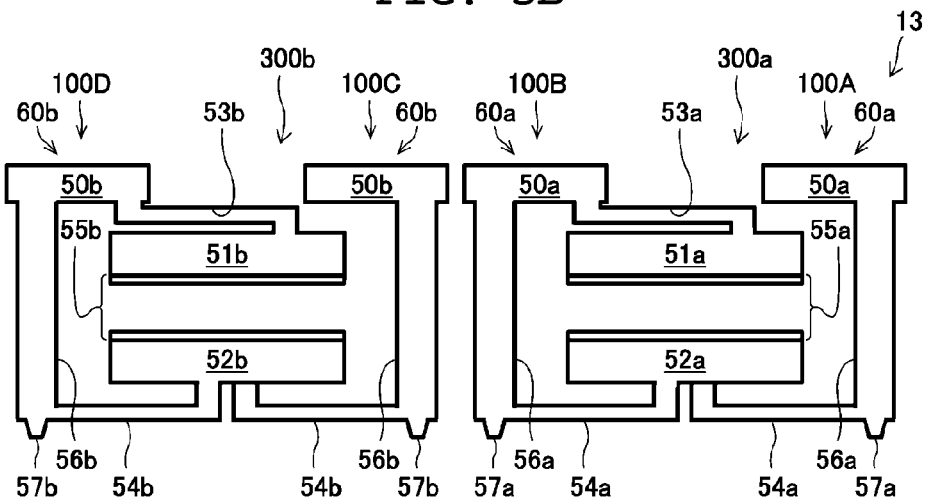
FIG. 3B is a schematic view depicting the cross-sectional structure of the liquid discharge head.

As depicted in FIG. 2, the line head 12 has a lower surface which faces or is opposite to the sheet P, and has a length not less than a length, of the sheet P, in a direction (orthogonal direction) orthogonal to a direction (conveying direction) in which the sheet P is conveyed. The above-described lower surface is a nozzle surface provided with nozzles 57 each of which is included in one of a plurality of individual channels 100 (FIGS. 3A and 3B to be described later on).

A tank 16 is connected to each of the nozzles 57. The tank 16 includes a sub tank 16*b* arranged on the line head 12 and a storing tank 16*a* connected to the sub tank 16*b* via a tube 17. The liquid is stored in the sub tank 16*b* and the storing tank 16*a*. The tank 16 is provided corresponding to a number of the liquid discharged or ejected from the nozzles 57; for example, the tank 16 is provided as four tanks 16 corresponding to liquids of four colors (black, yellow, cyan and magenta). With this, the line head 12 discharges or ejects a plurality of kinds of liquids.

In such a manner, the line head 12 is fixed, without being moved, and discharges the liquids from the plurality of nozzles 57. Together with this discharge, the sheet P is conveyed in the conveying direction by the conveyer. With this, the image is recorded on the sheet P. Note that the foregoing explanation has been made with respect to a case, as an example, in which the liquid discharge heads 13 construct the line head 12. It is allowable, however, that a liquid discharge head 13 may be a serial head, rather than that the liquid discharge heads 13 construct the line head 12.

<Configuration of Liquid Discharge Head>

An explanation will be given about the configuration of each of the liquid discharge heads 13, with reference to FIGS. 3A and 3B. Note that FIG. 3B depicts the cross-sectional structure of the liquid discharge head 13, as depicted in FIG. 3A, as taken along the individual channels (first individual channels 60*a* and second individual channels 60*b* which will be described later on). Further, in FIGS. 3A and 3B, a piezoelectric plate which is arranged at a location above a first pressure chamber 50*a* and a second pressure chamber 50*b* (to be described later on) and which applies pressure to the liquid inside the first pressure chamber 50*a* or the second pressure chamber 50*b* is omitted from the illustration, for the convenience of the explanation.

Respective parts provided on the liquid discharge head 13 can be formed by applying a processing such as the etching (half etching) or machining, etc., with respect to each of a plurality of plates, and by stacking these plates. Alternatively, the respective parts provided on the liquid discharge head 13 may be formed by stacking a plurality of resin plates each of which is molded to have a predetermined shape.

Each of FIGS. 3A and 3B depicts a liquid discharge head 13 in which four different nozzle rows (first nozzle row 100A, a second nozzle row 100B, a third nozzle row 100C and a fourth nozzle row 100D) are arranged. In the present embodiment, the first nozzle row 100A and the second nozzle row 100B are provided on a first island part 300*a* constructed of a first supply manifold 51*a* and a first return manifold 52*a*. Further, the third nozzle row 100C and the fourth nozzle row 100D are provided on a second island part 300*b* constructed of a second supply manifold 51*b* and a second return manifold 52*b*.

In the following, a supply manifold to which the first individual channels 60*a* connect is referred to as the first supply manifold Ma, a return manifold to which the first individual channels 60*a* connect is referred to as the first return manifold 52*a*. Similarly, a supply manifold to which the second individual channels 60*a* connect is referred to as the second supply manifold Mb, a return manifold to which the second individual channels 60*b* connect is referred to as the second return manifold 52*b*. Further, the term "island part" is a unit including a supply manifold and a return manifold which are located to overlap with the pressure chambers provided with the respective individual channels, as seen in a plane view from the nozzle surface. Note that individual channels constructing the first nozzle row 100A provided on the first island part 300*a* and individual channels constructing the second nozzle row 100B provided on the first island part 300*a* have a similar configuration. Accordingly, these individual channels are collectively referred to the "first individual channels 60*a*". Further, individual channels constructing the third nozzle row 100C provided on the second island part 300*b* and individual channels constructing the fourth nozzle row 100D provided on the second island part 300*b* have a similar configuration. Accordingly, these individual channels are collectively referred to the "second individual channels 60*b*".

Each of the first individual channels 60*a* has a first pressure chamber 50*a*, a first descender 56*a* which communicates with the first pressure chamber 50*a*, and a first nozzle 57*a* which communicates with the first descender 56*b* and via which a liquid droplet of the liquid is discharged or ejected. In a case that a side on which the first nozzle 57*a* is provided is defined as a down direction or below, and a side opposite to this side is defined as an up direction or above, the first pressure chamber 50*a* is provided at a location above the first descender 56*a*. A piezoelectric plate (piezoelectric body) is arranged on the upper surface of the first pressure chamber 50*a*, and a pressure is applied to the liquid inside the first pressure chamber 50*a* by the piezoelectric plate at a predetermined timing. Specifically, in a case that a voltage is applied to the piezoelectric plate at a predetermined timing, the volume of the pressure chamber 50*a* having the piezoelectric plate arranged on the upper surface thereof is changed so as to apply the pressure to the liquid inside the first pressure chamber 50*a*. With this, it is possible to discharge or eject the liquid droplet from the first nozzle 57*a*.

Further, each of the first individual channels 60*a* is provided with a first supply throttle part 53*a* and is connected to the first supply manifold Ma via the first supply throttle part 53*a*. Furthermore, each of the first individual channels 60*a* is provided with a first return throttle part 54*a* and is connected to the first return manifold 52*a* via the first return throttle part 54*a*. Specifically, the first supply manifold 51*a* and the first pressure chamber 50*a* of each of the first individual channels 60*a* are connected to each other by the first supply throttle part 53*a* of which channel diameter is made small. Further, the first nozzle 57*a* of each of the first individual channels 60*a* and the first return manifold 52*a* are connected to each other by the first return throttle part 54*a* of which channel diameter is made small.

In the liquid discharge apparatus 1, the liquid such as the ink, etc., fed from the tank 16 is supplied to the first supply manifold Ma via a first inlet port 58*a*. The liquid supplied to the first supply manifold Ma is supplied to the first pressure chamber 50*a* of each of the first individual channels 60*a* via the first supply throttle part 53*a*. The liquid to which the pressure is applied in the first pressure chamber 50*a* flows through the first descender 56*a* to be guided to the first nozzle 57*a*, and is discharged from the first nozzle 57*a* in a state of being the liquid droplet. Here, the liquid which has not been discharged from the first nozzle 57*a* is fed to the first return manifold 52*a* via the first return throttle part 54*a*. The liquid fed to the first return manifold 52*a* is returned to the tank 16 via a first outlet port 59*a*. In such a manner, each of the first individual channels 60*a* provided on the first island part 300*a* is configured to perform nozzle circulation. Note that the inside of the first supply manifold 51*a* has the normal pressure so as to feed the liquid to the first pressure chamber 50*a*. Further, the inside of the first return manifold 52*a* has the negative pressure so as to pull thereinto the liquid which has not been discharged from the first nozzle 57*a*.

Furthermore, the first supply manifold 51*a* and the first return manifold 52*a* are arranged to overlap with each other, as seen in a plan view from the nozzle surface in which the first nozzles 57*a* are formed. In a case that a side on which the nozzle surface is formed is defined as the down direction or below, and a side opposite to this side is defined as the up direction or above in the liquid discharge head 13, the supply manifold 51*a* is arranged at a location above the first return manifold 52*a*. Moreover, a first damper 55*a* is provided between the first supply manifold 51*a* and the first return manifold 52*a*. It is possible to suppress, by the first damper 55*a*, any effect of a pressure wave propagated from the first pressure chamber 50*a* to the first supply manifold 51*a* via the first supply throttle part 53*a*. Further, it is also possible to suppress, by the first damper 55*a*, any effect of a pressure wave propagated to the first return manifold 52*a* via the first return throttle part 54*a*.

Further, each of the second individual channels 60*b* also has a configuration similar to that of each of the first individual channels 60*a* as described above. Namely, each of the second individual channels 60*b* has a second pressure chamber 50*b*, a second descender 56*b* which communicates with the second pressure chamber 50*b*, and a second nozzle 57*b* which communicates with the second descender 56*b* and via which a liquid droplet of the liquid is discharged or ejected. Further, each of the second individual channels 60*b* is connected to the second supply manifold 51*b* via a second supply throttle part 53*b*, and is connected to the second return manifold 52*b* via a second return throttle part 54*b*.

Furthermore, the second supply manifold 51*b* and the second return manifold 52*b* are arranged to overlap with each other, as seen from the nozzle surface, and a second damper 55*b* is provided between the second supply manifold 51*b* and the second return manifold 52*b*. Each of the above-described first damper 55*a* and the second damper 55*b* is formed of two plates (a first damper plate 80 and a second damper plate 81 in FIG. 4 which will be described later on) in which recessed areas are formed so as to form a damper space. Note that since each of the second individual channels 60*b* has a configuration similar to that of each of the first individual channels 60*a*, any detailed explanation therefor will be omitted.

Although the first individual channels 60*a* and the second individual channels 60 are different in view of the island parts on which these individual channels are provided, each of the first individual channels 60*a* and the second individual channels 60 has a configuration in which a circulation channel for the liquid is connected thereto by a first bypass channel 70 which will be described later on with reference to FIG. 6. The first supply manifold 51*a* and the second return manifold 52*b* are connected to each other by the first bypass channel 70. With this, a part of the liquid inside the first supply manifold 51*a* is made to circulate or flow to the second return manifold 52*b*. Further, it is possible to realize a manifold circulation between the first supply manifold 51*a* and the second return manifold 52*b*.

Here, a part of the constituent components of the first bypass channel 70 will be explained by using FIG. 4. Note that the detailed configuration of the first bypass channel 70 will be explained later by using FIGS. 6 and 7.

Figure 4:
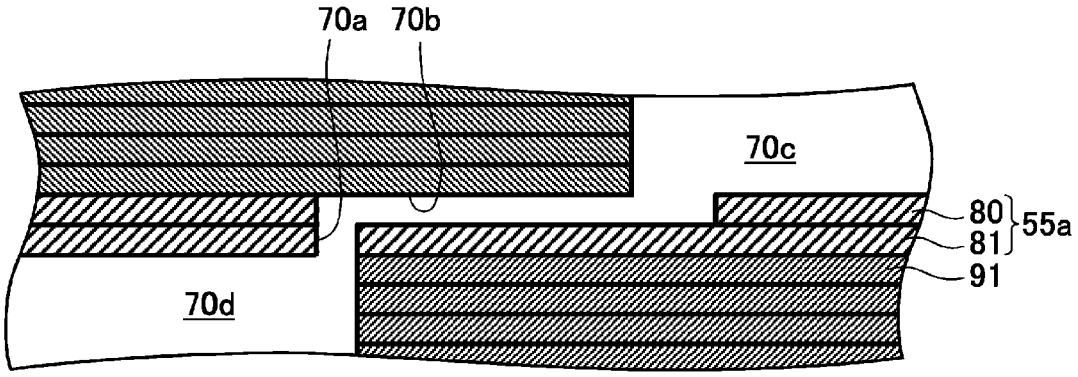
FIG. 4 is a cross-sectional view depicting a part of constituent components of a first bypass channel.

As depicted in FIG. 4, the part of the constituent elements of the first bypass channel 70 is formed in the first damper plate 80 and the second damper plate 81 constructing the first damper 55*a* as described above. The first damper plate 80 and the second damper plate 81 are walls defining or demarcating the first supply manifold 51*a* and the second return manifold 52*b* from each other. The first damper plate 80 functions also as a plate defining the bottom surface of the first supply manifold 51*a*, and the second damper plate 81 functions also as a plate defining the upper surface of the second return manifold 52*b*. By cutting off a part of the first damper plate 80, a first flow channel 70*b* as a constituent component of the first bypass channel 70 is provided. The first flow channel 70*b* communicates with the inside of the first supply manifold 51*a*.

Further, a first connecting channel 70*a* is provided by forming a hole penetrating, in the up-down direction, through the second damper plate 81 at an area thereof in which the first damper 55*a* and the second damper 55*b* are not formed. The first connecting channel 70*a* communicates with the inside of the second return manifold 52*b* at an end part thereof, and communicates with the first flow channel 70*b* at the other end part thereof. The first flow channel 70*b* is arranged at a position at which the first flow channel 70*b* overlaps with each of the first supply manifold 51*a* and the first connecting channel 70*a* in a case that the first flow channel 70*b* is seen in a plane view from the nozzle surface.

The first bypass channel 70 can be formed by performing a processing such as the etching or machining with respect to each of the first damper plate 80 and the second damper plate 81 and by stacking the first damper plate 80 and the second damper plate 81. Alternatively, it is allowable that the first damper plate 80 and the second damper plate 81 are resin plates each of which is formed to have a predetermined shape, and that these plates are stacked to thereby form the first bypass channel 70. By appropriately setting the shape and the size of each of the first connecting channel 70*a* and the first flow channel 70*b*, it is possible to easily adjust the pressure of the fluid flowing therethrough.

Further, the liquid discharge head 13 has such a configuration that the second supply manifold 51*b* and the first return manifold 52*a* are connected to each other by a second bypass channel 71, and that a part of the liquid inside the second supply manifold 51*b* is made to circulate or flow to the first return manifold 52*a*. Furthermore, it is possible to realize a manifold circulation between the second supply manifold 51*b* and the first return manifold 52*a*.

Here, a part of the constituent components of the second bypass channel 71 will be explained by using FIG. 5. Note that the detailed configuration of the second bypass channel 71 will be explained later by using FIGS. 6 and 7.

Figure 5:
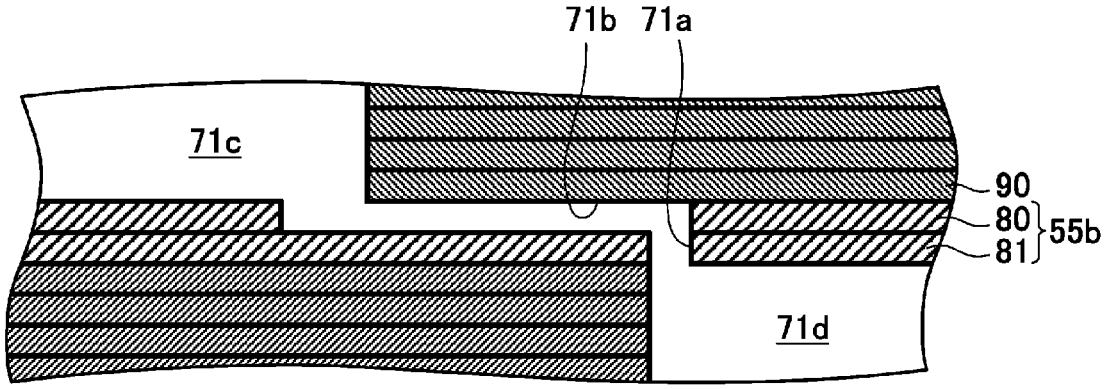
FIG. 5 is a cross-sectional view depicting a part of constituent components of a second bypass channel.

As depicted in FIG. 5, the part of the constituent elements of the second bypass channel 71 is formed in the first damper plate 80 and the second damper plate 81 as described above. The first damper plate 80 and the second damper plate 81 are walls defining or demarcating the second supply manifold 51*b* and the first return manifold 52*a* from each other. The first damper plate 80 functions also as a plate defining the bottom surface of the second supply manifold 51*b*, and the second damper plate 81 functions also as a plate defining the upper surface of the first return manifold 52*a*. By cutting off a part of the first damper plate 80, a second flow channel 71*b* as a constituent component of the second bypass channel 71 is provided. The second flow channel 71*b* communicates with the inside of the second supply manifold 51*b*.

Further, a second connecting channel 71*a* is provided by forming a hole penetrating, in the up-down direction, through the second damper plate 81 at an area thereof in which the first damper 55*a*, the second damper 55*b* and the first bypass channel 70 are not formed. The second connecting channel 71*a* communicates with the inside of the first return manifold 52*a* at an end part thereof, and communicates with the second flow channel 71*b* at the other end part thereof. The second flow channel 71*b* is arranged at a position at which the second flow channel 71*b* overlaps with each of the second supply manifold 51*b* and the second connecting channel 71*a* in a case that the second flow channel 71*b* is seen in a plane view from the nozzle surface. Note that the second bypass channel 71 can be formed by a method similar to the method forming the first bypass channel 70 as described above.

In the following, an explanation will be given about the positional relationship among the first supply manifold 51*a* and the first return manifold 52*a* constructing the first island part 300*a*, the second supply manifold 51*b* and the second return manifold 52*b* constructing the second island part 300*b*, and the first bypass channel 70 and the second bypass channel 71, with reference to FIG. 6.

Figure 6:
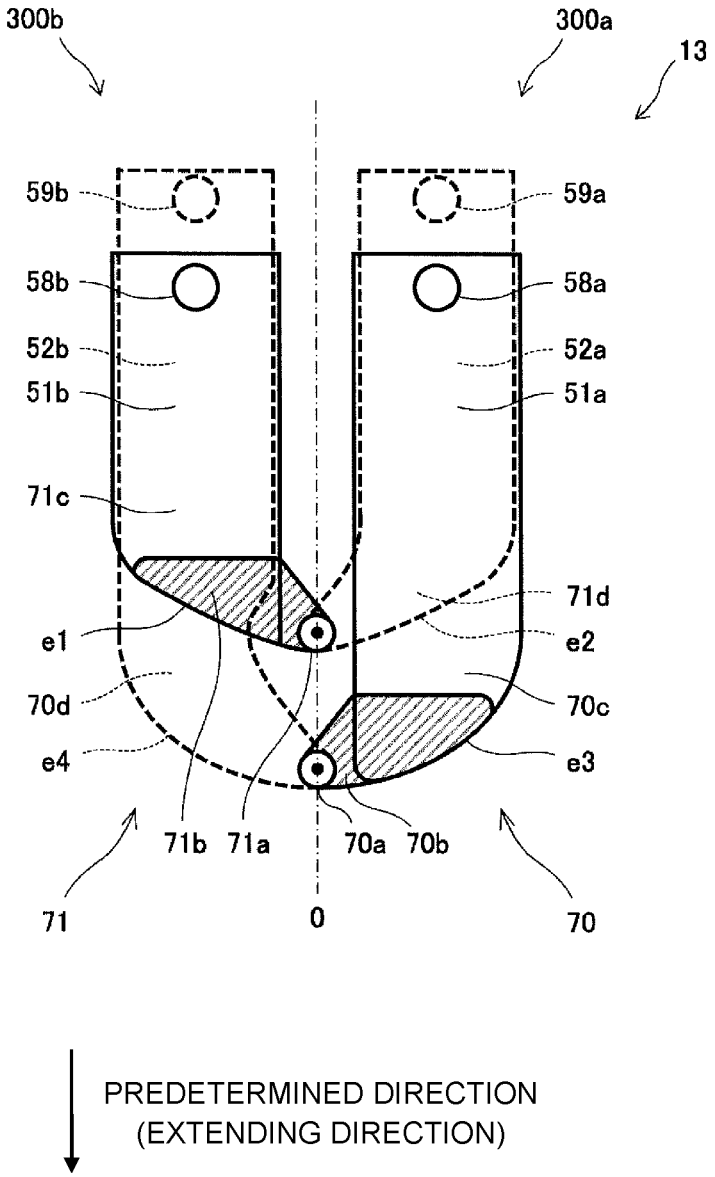
FIG. 6 is a plane view depicting arrangement of a first supply manifold, a first return manifold, a second supply manifold, a second return manifold, the first bypass channel and the second bypass channel.

In FIG. 6, the first supply manifold 51*a* and the second supply manifold 51*b* are depicted in solid lines, and the first return manifold 52*a* and the second return manifold 52*b* are depicted in broken lines. Further, the illustration of the group of the first individual channels 60*a* and the group of the second individual channels 60*b* are omitted in FIG. 6.

As depicted in FIG. 6, in a case that, in the liquid discharge head 13 of the present embodiment, the first supply manifold 51*a* and the first return manifold 52*a* are seen in a plane view from the nozzle surface, the first supply manifold 51*a* and the first return manifold 52*a* are arranged to overlap with each other, and extend in a same direction. The first supply manifold 51*a* and the first return manifold 52*a* have lengths in the extending direction (corresponding to the predetermined direction) thereof which are different from each other. Further, in a case that, in the liquid discharge head 13, the second supply manifold 51*b* and the second return manifold 52*b* are seen in a plane view from the nozzle surface, the second supply manifold 51*b* and the second return manifold 52*b* are arranged to overlap with each other, and extend in a same direction. The second supply manifold 51*b* and the second return manifold 52*b* have lengths in the extending direction thereof which are different from each other. From the foregoing description, in the present embodiment, all the first supply manifold 51*a*, the second supply manifold 51*b*, the first return manifold 52*a* and the second return manifold 52*b* extend in the same extending direction.

A position of a forward end part in the extending direction of the first supply manifold 51*a* and a position of a forward end part in the extending direction of the second return manifold 52*b* are at substantially same positions, respectively, and the first bypass channel 70 connects the forward end parts of the first supply manifold 51*a* and the second return manifold 52*b*. Further, the first inlet port 58*a* is provided on the first supply manifold 51*a* on the side of an end part (referred to as a base end part) thereof which is on the opposite side to the forward end part of the first supply manifold 51*a*, and the second outlet port 59*b* is provided on the side of a base end part of the second return manifold 52*b*.

Furthermore, a position of a forward end part in the extending direction of the second supply manifold 51*b* and a position of a forward end part in the extending direction of the first return manifold 52*a* are at substantially same positions, respectively, and the second bypass channel 71 connects the forward end parts of the second supply manifold 51*b* and the first return manifold 52*a*. Moreover, the second inlet port 58*b* is provided on the side of a base part of the second supply manifold 51*b*, and the first outlet port 59*a* is provided on the side of a base end part of the first return manifold 52*a*. In such a manner, in the present embodiment, the first inlet port 58*a*, the second inlet port 58*b*, the first outlet port 59*a* and the second outlet port 59*b* are arranged on the side of one end in the extending direction.

Further, the first bypass channel 70 is located at a position which is farther from the second bypass channel 71 in the extending direction, and the first bypass channel 70 and the second bypass channel 71 are arranged so as not to overlap with each other. Namely, the second bypass channel 71 is arranged on a side closer to the one end in the predetermined direction (a side on which the respective ports are arranged) than the first bypass channel 70.

Figure 7:
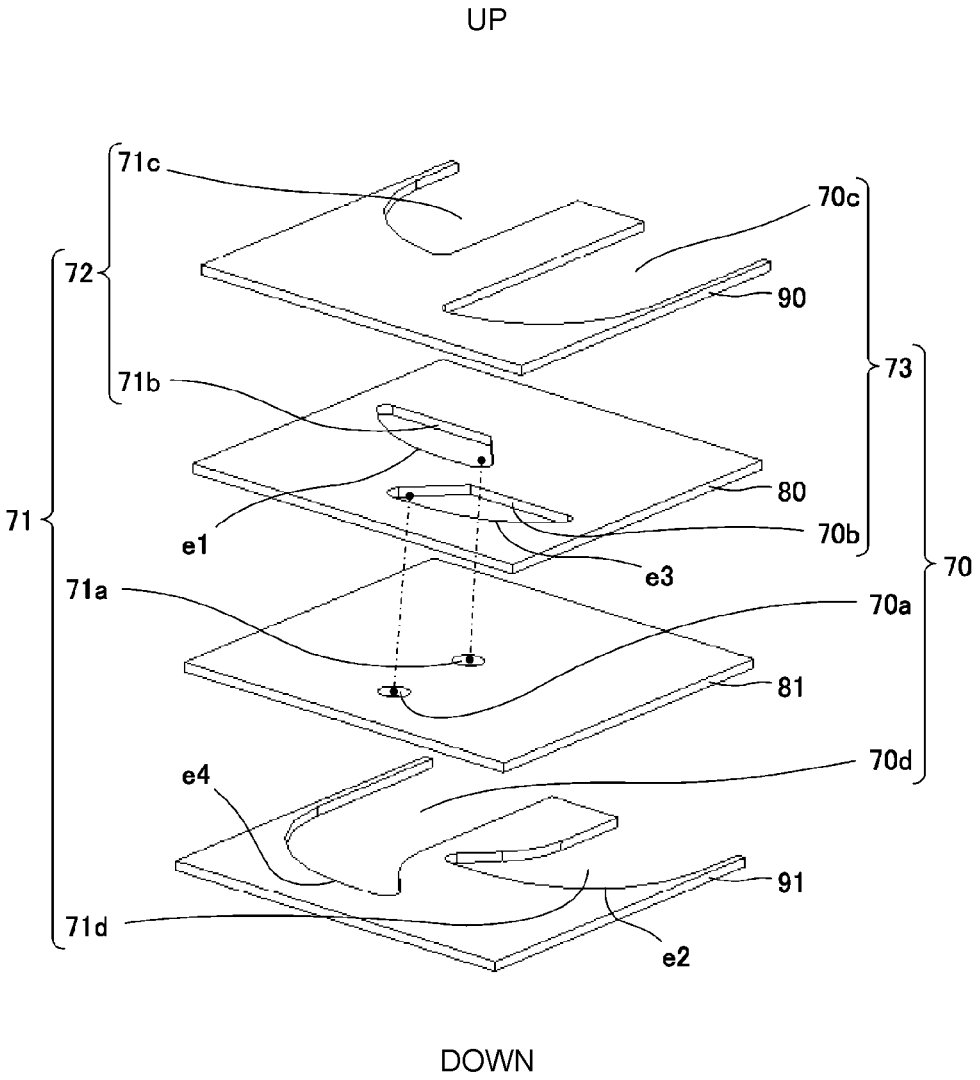
FIG. 7 is an exploded perspective view depicting the configuration of each of the first bypass channel and the second bypass channel.

In the following, the detailed configuration of each of the first bypass channel 70 and the second bypass channel 71 will be explained. FIG. 7 is an exploded perspective view depicting the configuration of each of the first bypass channel 70 and the second bypass channel 71.

<Details of First Bypass Channel>

As depicted in FIG. 7, the first bypass channel 70 includes a first supply connecting channel 73 connected to the first supply manifold Ma, a first return connecting channel 70*d* connected to the second return manifold 52*b*, and the above-described first connecting channel 70*a* between the first supply connecting channel 73 and the first return connecting channel 70*d*. The first supply connecting channel 73 includes the above-described first flow channel 70*b* and a first supply extended part 70*c* communicating with the first supply manifold 51*a*. The first connecting channel 70*a* is formed, for example, to have a cylindrical shape.

In a state that the respective plates are stacked, the first supply extended part 70*c* in the plate 90, the first flow channel 70*b* cut in the first damper plate 80, the first connecting channel 70*a* penetrating the second damper plate 81 and the first return connecting channel 70*d* in the plate 91 communicate with one another. With this, the first supply manifold Ma and the second return manifold 52*b* are allowed to communicated with each other by the first bypass channel 70.

The first flow channel 70*b* is formed to have, for example, a fan shape. Specifically, the first flow channel 70*b* has an outer edge e3 having an arc shape curved so as to correspond to an arc-shaped forward end part of the first supply extended part 70*c*. Further, a forward end part of the first return connecting channel 70*d* is shaped to curve in an arc form, and has an arc-shaped outer edge e4.

The channel resistance in at least one of the first supply connecting channel 73 and the first return connecting channel 70*d* is greater than channel resistance in the first connecting channel 70*a*. In the present embodiment, the channel resistance in the first supply connecting channel 73 and the channel resistance in the first return connecting channel 70*d* are both greater than the channel resistance in the first connecting channel 70*a*. Note that the channel resistance in the first supply connecting channel 73 includes at least the channel resistance in the first flow channel 70*b*. For example, in a case that the viscosity of the ink is 7 cps, the channel resistance in the first supply connecting channel 73 is, for example, in a range of $3.0\times10^{11}$ kg/m$^4$·s to $3.5\times10^{11}$ kg/m$^4$·s, the channel resistance in the first return connecting channel 70*d* is, for example, in a range of $1.5\times10^{11}$ kg/m$^4$·s to $2.0\times10^{11}$ kg/m$^4$·s, and the channel resistance in the first connecting channel 70*a* is, for example, in a range of $3.0\times10^{9}$ kg/m$^4$·s to $4.0\times10^{9}$ kg/m$^4$·s.

Further, the radius of curvature of the outer edge e3 of the first flow channel 70*b* of the first supply connecting channel 73 is greater than the radius of curvature of the outer edge e4 of the first return connecting channel 70*d*.

Furthermore, the compliance of the first supply connecting channel 73 is greater than the compliance of the first return connecting channel 70*d*. Note that the compliance of each of the connecting channels can be obtained by a calculation formula: $Cp=V/c^2\times\rho$. Note that in the calculation formula, "V" is the volume of each of the connecting channels, "c" is the acoustic velocity of liquid (acoustic velocity of ink) inside each of the connecting channels, and "ρ" is the density of liquid (density of ink). The density of ink is, for example, 1054 kg/m$^3$. Further, the acoustic velocity of ink inside each of the connecting channels is, for example, 91 m/s.

In the above-described configuration, the liquid inside the first supply manifold 51*a* flows into the first flow channel 70*b* of which opening shape is greater than that of the first connecting channel 70*a*. Further, in the first flow channel 70*b*, the liquid flows toward the position of the end part thereof having the arc shape and overlapping with the first connecting channel 70*a*. The channel width of the first flow channel 70*b* is gradually narrowed toward the position of the end part having the arc shape. Accordingly, the magnitude of the pressure of the liquid flowed into the first flow channel 70*b* is adjusted before the liquid reaches the first connecting channel 70*a*, and the liquid flows into the second return manifold 52*b* via the first connecting channel 70*a* and the first return connecting channel 70*d*.

<Details of Second Bypass Channel>

Similarly to the first bypass channel 70, the second bypass channel 71 includes a second supply connecting channel 72 connected to the second supply manifold 51*b*, a second return connecting channel 71*d* connected to the first return manifold 52*a*, and the above-described second connecting channel 71*a* between the second supply connecting channel 72 and the second return connecting channel 71*d*. The second supply connecting channel 72 includes the above-described second flow channel 71*b* and a second supply extended part 71*c* communicating with the second supply manifold 51*b*. The second connecting channel 71*a* is formed, for example, to have a cylindrical shape similarly to the first connecting channel 70*a*, and has a hole diameter which is smaller than a hole diameter of the first connecting channel 70*a*.

In the state that the respective plates are stacked, the second supply extended part 71*c* in the plate 90, the second flow channel 71*b* cut in the first damper plate 80, the second connecting channel 71*a* penetrating the second damper plate 81 and the second return connecting channel 71*d* in the plate 91 communicate with one another. With this, the second supply manifold 51*b* and the first return manifold 52*a* are allowed to communicated with each other by the second bypass channel 71.

The second flow channel 71*b* is formed to have, for example, a fan shape. Specifically, the second flow channel 71*b* has an outer edge e1 having an arc shape curved so as to correspond to an arc-shaped forward end part of the second supply extended part 71*c*. Further, a forward end part of the second return connecting channel 71*d* is shaped to curve in an arc form, and has an arc-shaped outer edge e2.

The channel resistance in at least one of the second supply connecting channel 72 and the second return connecting channel 71*d* is greater than channel resistance in the second connecting channel 71*a*. In the present embodiment, the channel resistance in the second supply connecting channel 72 and the channel resistance in the second return connecting channel 71*d* are both greater than the channel resistance in the second connecting channel 71*a*. Note that the channel resistance in the second supply connecting channel 72 includes at least the channel resistance in the second flow channel 71*b*.

Further, the radius of curvature of the outer edge e1 of the second flow channel 71*b* of the second supply connecting channel 72 is greater than the radius of curvature of the outer edge e2 of the second return connecting channel 71.

Furthermore, the compliance of the second supply connecting channel 72 is greater than the compliance of the second return connecting channel 71*d*.

In the above-described configuration, the liquid inside the second supply manifold Mb flows into the second flow channel 71*b* of which opening shape is greater than that of the second connecting channel 71*a*. Further, in the second flow channel 71*b*, the liquid flows toward the position of the end part thereof having the arc shape and overlapping with the second connecting channel 71*a*. The channel width of the second flow channel 71*b* is gradually narrowed toward the position of the end part having the arc shape, in a similar manner regarding the first flow channel 70*b*. Accordingly, the magnitude of the pressure of the liquid flowed into the second flow channel 71*b* is adjusted before the liquid reaches the second connecting channel 71*a*, and the liquid flows into the first return manifold 52*a* via the second connecting channel 71*a* and the second return connecting channel 71*d*.

<Comparison Between First Bypass Channel and Second Bypass Channel>

In the present embodiment, the second bypass channel 71 has the channel resistance which is greater than that of the first bypass channel 70.

Further, the cross-sectional area of at least one of the first flow channel 70*b* of the first supply connecting channel 73 and the first return connecting channel 70*d* is greater than the cross-sectional area of the second flow channel 71*b* of the second supply connecting channel 72 and the cross-sectional area of the second return connecting channel 71*d*. In the present embodiment, the cross-sectional area of the first flow channel 70*b* of the first supply connecting channel 73 and the cross-sectional area of the first return connecting channel 70*d* are both greater than the cross-sectional area of the second flow channel 71*b* of the second supply connecting channel 72 and the cross-sectional area of the second return connecting channel 71*d*. Note that as the cross-sectional area of each of the channels, it is possible to adopt the maximum value among the cross-sectional areas of each of the respective channel.

Furthermore, the radius of curvature of at least one of the outer edge e1 of the second flow channel 71*b* of the second supply connecting channel 72 and the outer edge e2 of the second return connecting channel 71*d* is greater than the radius of curvature of the outer edge e3 of the first flow channel 70*b* of the first supply connecting channel 73 and the radius of curvature of the outer edge e4 of the first return connecting channel 70*d*. Moreover, the radius of curvature of at least one of the outer edge e3 of the first flow channel 70*b* of the first supply connecting channel 73 and the outer edge e4 of the first return connecting channel 70*d* is smaller than the radius of curvature of the outer edge e1 of the second flow channel 71*b* of the second supply connecting channel 72 and the radius of curvature of the outer edge e2 of the second return connecting channel 71*d*. In the present embodiment, the radius of curvature of the outer edge e1 of the second flow channel 71*b* of the second supply connecting channel 72 and the radius of curvature of the outer edge e2 of the second return connecting channel 71*d* are greater than the radius of curvature of the outer edge e3 of the first flow channel 70*b* of the first supply connecting channel 73 and the radius of curvature of the outer edge e4 of the first return connecting channel 70*d*.

As explained above, in the liquid discharge head 13 of the present embodiment, the channel resistance in at least one of the first supply connecting channel 73 and the first return connecting channel 70*d* is made to be greater than the channel resistance in the first connecting channel 70*a*. With this, it is possible to make the difference in the channel resistance in the entire first bypass channel 70 to be substantially absent, even in a case that any deviation in the adhesion among the plates occurs and that a part of the first connecting channel 70*a* is clogged. This is similarly applicable also to the second bypass channel 71. With this, it is possible to allow the liquid to flow from the first supply manifold 51*a* to the second return manifold 52*b* in the desired flow amount, and to allow the liquid to flow from the second supply manifold 51*b* to the first return manifold 52*a* in the desired flow amount.

Further, in the present embodiment, the second bypass channel 71 is arranged on the side closer to the one end in the extending direction (the side on which the respective ports are arranged) than the first bypass channel 70, and has the channel resistance higher than the channel resistance of the first bypass channel 70. Regarding this point, since the channel resistance in the first bypass channel 70 is high due to that the first bypass channel 70 is at a position which is far from the first inlet port 58*a*, the channel resistance in the second bypass channel 71 is made to be great. Due to this, it is possible to make the difference between the resistance in entirety of the first supply manifold 51*a*, the first bypass channel 70 and the second return manifold 52*b* and the resistance in the entirety of the second supply manifold 51*b*, the second bypass channel 71 and the first return manifold 52*a* to be small, thereby making it possible to make the flow amount to be same between the respective bypass channels 70 and 71. Note that the resistance in the entirety of the second bypass channel 71 is, for example, in a range of $4.0\times10^{11}$ kg/m$^4$·s to $5.0\times10^{11}$ kg/m$^4$·s, and the resistance in the entirety of the first bypass channel 70 is, for example, in a range of $3.0\times10^{11}$ kg/m$^4$·s to $3.9\times10^{11}$ kg/m$^4$·s, Furthermore, in the present embodiment, the cross-sectional area of the first flow channel 70*b* of the first supply connecting channel 73 and the cross-sectional area of the first return connecting channel 70*d* are both greater than the cross-sectional area of the second flow channel 71*b* of the second supply connecting channel 72 and the cross-sectional area of the second return connecting channel 71*d*. With this, already ensuring the exhaust performance of the air, it is possible to make the difference between the resistance in entirety of the first supply manifold 51*a*, the first bypass channel 70 and the second return manifold 52*b* and the resistance in the entirety of the second supply manifold 51*b*, the second bypass channel 71 and the first return manifold 52*a* to be small, with a simple configuration.

Moreover, in the present embodiment, each of the first connecting channel 70*a* and the second connecting channel 71*a* is formed to have the cylindrical shape. In this configuration, in a case that each of the first connecting channel 70*a* and the second connecting channel 71*a* has a cross-sectional area which is same as that of a channel having a rectangular cylindrical shape or triangular cylindrical shape, the channel resistance in each of the first connecting channel 70*a* and the second connecting channel 71*a* is lowered and the liquid is allowed to easily flow therethrough, thereby making it possible to make the liquid to flow in a large flow amount.

Further, in the present embodiment, the hole diameter of the second connecting channel 71*a* is smaller than the hole diameter of the first connecting channel 70*a*. Due to this, it is possible to make the difference between the resistance in the entirety of the first supply manifold 51*a*, the first bypass channel 70 and the second return manifold 52*b* and the resistance in the entirety of the second supply manifold 51*b*, the second bypass channel 71 and the first return manifold 52*a* to be small, with a simple configuration. Note that the hole diameter of the second connecting channel 71*a* is, for example, in a range of 0.2 mm to 0.3 mm. The channel resistance in the second connecting channel 71*a* is, for example, in a range of $1.0\times10^9$ kg/m$^4$·s to $2.0\times10^9$ kg/m$^4$·s. Furthermore, the hole diameter of the first connecting channel 70*a* is, for example, in a range of 0.4 mm to 0.5 mm. The channel resistance in the first connecting channel 70*a* is, for example, in a range of $3.0\times10^9$ kg/m$^4$·s to $4.0\times10^9$ kg/m$^4$·s.

Further, in the present embodiment, the radius of curvature of the outer edge e1 of the second flow channel 71*b* of the second supply connecting channel 72 and the radius of curvature of the outer edge e2 of the second return connecting channel 71*d* are greater than the radius of curvature of the outer edge e3 of the first flow channel 70*b* of the first supply connecting channel 73 and the radius of curvature of the outer edge e4 of the first return connecting channel 70*d*. In this configuration, in a case of making the difference in the channel resistance between the respective bypass channels 70 and 71 to be small, the outer edge is longer than the inner edge, and thus the radius of curvature of the outer edge can be adjusted more easily. Furthermore, the air can be easily exhausted toward the respective downstream sides, with the first connecting channel 70*a* and the second connecting channel 71*a* as the references (namely, toward the side of the first return connecting channel 70*d* and the side of the second return connecting channel 71*d*).

Moreover, in the present embodiment, the radius of curvature of the outer edge e3 of the first flow channel 70*b* of the first supply connecting channel 73 is greater than the radius of curvature of the outer edge e4 of the first return connecting channel 70*d*. Further, the radius of curvature of the outer edge e1 of the second flow channel 71*b* of the second supply connecting channel 72 is greater than the radius of curvature of the outer edge e2 of the second return connecting channel 71*d*. In this case, a case of adjusting the outer edges on the downstream side (OUT side) of the respective bypass channels 70 and 71 makes it possible to suppress the lowering in the exhaust performance of air, as compared with another case of adjusting the outer edges on the upstream side (IN side) of the respective bypass channels 70 and 71.

Further, in the present embodiment, the compliance of the first supply connecting channel 73 is greater than the compliance of the first return connecting channel 70*d*. Furthermore, the compliance of the second supply connecting channel 72 is greater than the compliance of the second return connecting channel 71*d*. Regarding this point, in a case of the configuration wherein an actuator is arranged on the upper side (the side of the pressure chamber) as in the present embodiment, the first and second supply manifolds 51*a* and 51*b*, which are close to the actuator, are relatively likely to be greatly affected by the crosstalk by the driving of the actuator. In view of this, by making the compliance of the first supply connecting channel 73 and the compliance of the second supply connecting channel 72 to be relatively great, it is possible to make the effect of the crosstalk to be small as much as possible.

<Modifications>

The present disclosure is not limited to or restricted by the above-described embodiment; a variety of kinds of modifications are possible, within a range not departing from the spirit of the present disclosure, as exemplified as follows.

In the above-described embodiment, the aspect wherein the liquid discharge head 13 is provided with the first supply manifold 51*a*, the second return manifold 52*b*, the second supply manifold 51*b* and the first return manifold 52*a*, as depicted in FIG. 3B. The present disclosure, however, is not limited to this; it is allowable to adopt a liquid discharge head provided with one supply manifold and one return manifold.

Figure 8:
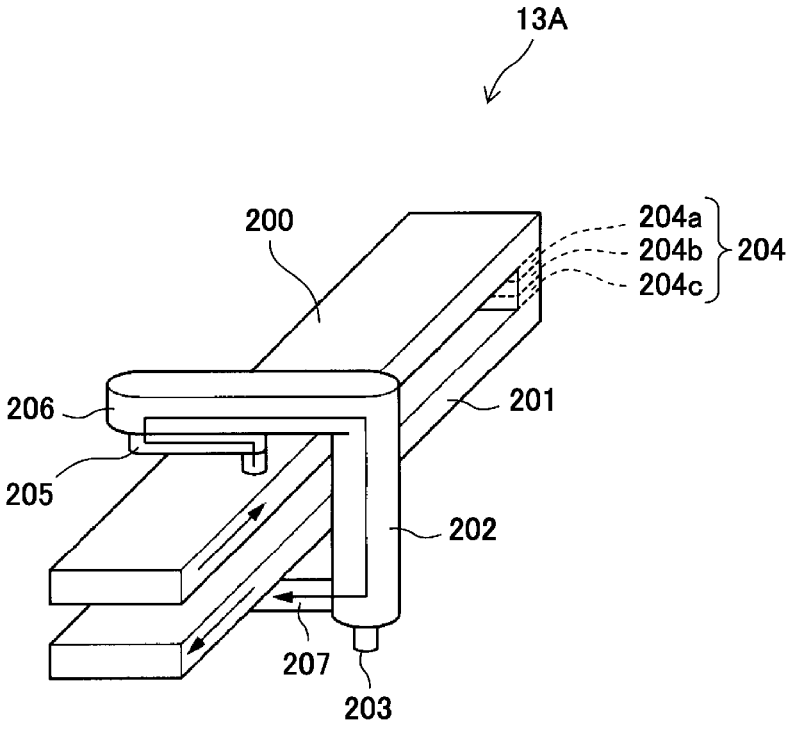
FIG. 8 is a perspective view depicting the configuration of another liquid discharge head.

As depicted in FIG. 8, a liquid discharge head 13A according to a modification is provided with: a supply manifold 200 to which a liquid is supplied from outside; a return manifold 201 from which the liquid is exhausted or discharged to the outside; and a plurality of individual channels 202 each of which has an upstream end connected to the supply manifold 200 and a downstream end connected to the return manifold 201, and each of which communicates individually with a one of a plurality of pressure chambers 206 and one of a plurality of nozzles 203 which are aligned to form a row (array) in a nozzle surface. Further, the liquid discharge head 13A is provided with a bypass channel 204 connecting the supply manifold 200 and the return manifold 201 with each other. The liquid in the supply manifold 200 flows into each of the plurality of pressure chambers 206 via a supply throttle channel 205. Such a liquid discharge head 13A has a two-story structure wherein the supply manifold 200 is arranged at a location above the return manifold 201. Note that the liquid which has not been discharged or ejected from the plurality of nozzles 203 flows to the return manifold 201 via a return throttle channel 207.

The bypass channel 204 includes a supply-side connecting channel 204*a* connected to the supply manifold 200, a return-side connecting channel 204*c* connected to the return manifold 201, and a first connecting channel 204*b* between the supply-side connecting channel 204*a* and the return-side connecting channel 204*c*. In such a configuration, the channel resistance in at least one of the supply-side connecting channel 204*a* and the return-side connecting channel 204*c* is greater than the channel resistance in the first connecting channel 204*b*. In this modification, the channel resistance in the supply-side connecting channel 204*a* and the channel resistance in the return-side connecting channel 204*c* are both made to be greater than the channel resistance in the first connecting channel 204*b*.

In such a manner, in the liquid discharge head 13A according to the present modification, the channel resistance in the supply-side connecting channel 204*a* and the channel resistance in the return-side connecting channel 204*c* are both made to be greater than the channel resistance in the first connecting channel 204*b*. With this, it is possible to make the difference in the channel resistance in the entire first bypass channel 204 to be substantially absent, even in a case that any deviation in the adhesion among the plates occurs and that a part of the first connecting channel 204*b* is clogged. With this, it is possible to allow the liquid to flow from the supply manifold 200 to the return manifold 201 in a desired flow amount.

Further, in the above-described embodiment, in the liquid discharge head 13 as depicted in FIG. 6, the first supply manifold 51*a* and the second supply manifold 51*b* are configured such that the first inlet port 58*a* and the second inlet port 58*b* are provided on the side of the base end parts in the extending direction, of the first supply manifold 51*a* and the second supply manifold Mb, respectively, which are on the side opposite to the forward end parts in the extending direction of the first supply manifold Ma and the second supply manifold Mb (at which the first bypass channel 70 and the second bypass channel 71 are provided, respectively). Furthermore, the first return manifold 52*a* and the second return manifold 52*b* are also configured such that the first outlet port 59*a* and the second outlet port 59*b* are provided on the side of the base end parts in the extending direction, of the first return manifold 52*a* and the second return manifold 52*b*, respectively, which are on the side opposite to the forward end parts in the extending direction of the first return manifold 52*a* and the second return manifold 52*b*. The positions in each of which one of the first inlet port 58*a*, the second inlet port 58*b*, the first outlet port 59*a* and the second outlet port 59*b* is provided in not limited to being on the base end part in the extending direction. It is allowable that the first inlet port 58*a*, the second inlet port

58*b*, the first outlet port 59*a* and the second outlet port 59*b* are provided respectively on the first supply manifold Ma, the second supply manifold Mb, the first return manifold 52*a* and the second return manifold 52*b*, at ends parts, respectively, which are on different sides in the extending direction thereof. It is allowable that the first inlet port 58*a*, the second inlet port 58*b*, the first outlet port 59*a* and the second outlet port 59*b* are provided arbitrarily, depending on the arrangement or the shape of a channel (not depicted in the drawings) in which the liquid is supplied to the first supply manifold 51*a* via the first inlet port 58*a* and to the second supply manifold 51*b* via the second inlet port 58*b* and is allowed to flow, and the arrangement or the shape of a channel (not depicted in the drawings) in which the liquid is exhausted or discharged from the first return manifold 52*a* via the first outlet port 59*a* and from the second return manifold 52*b* via the second outlet port 59*b*.

Moreover, in the above-described embodiment, the channel resistance in the first supply connecting channel 73 and the channel resistance in the first return connecting channel 70*d* are both made to be greater than the channel resistance in the first connecting channel 70*a*. The present disclosure, however, is not limited to this. It is allowable that either one of the channel resistance in the first supply connecting channel 73 and the channel resistance in the first return connecting channel 70*d* is made to be greater than the channel resistance in the first connecting channel 70*a*.

Further, in the above-described embodiment, the channel resistance in the second supply connecting channel 72 and the channel resistance in the second return connecting channel 71*d* are both made to be greater than the channel resistance in the second connecting channel 71*a*. The present disclosure, however, is not limited to this. It is allowable that either one of the channel resistance in the second supply connecting channel 72 and the channel resistance in the second return connecting channel 71*d* is made to be greater than the channel resistance in the second connecting channel 71*a*.

Furthermore, in the above-described embodiment, the cross-sectional area of the first flow channel 70*b* of the first supply connecting channel 73 and the cross-sectional area of the first return connecting channel 70*d* are both made to be greater than the cross-sectional area of the second flow channel 71*b* of the second supply connecting channel 72 and the cross-sectional area of the second return connecting channel 71*d*. The present disclosure, however, is not limited to this. It is allowable that at least one of the cross-sectional area of the first flow channel 70*b* of the first supply connecting channel 73 and the cross-sectional area of the first return connecting channel 70*d* is made to be greater than the cross-sectional area of the second flow channel 71*d* of the second supply connecting channel 72 and the cross-sectional area of the second return connecting channel 71*d*.

Moreover, in the above-described embodiment, the radius of curvature of the outer edge e1 of the second flow channel 71*b* of the second supply connecting channel 72 and the radius of curvature of the outer edge e2 of the second return connecting channel 71*d* are made to be greater than the radius of curvature of the outer edge e3 of the first flow channel 70*b* of the first supply connecting channel 73 and the radius of curvature of the outer edge e4 of the first return connecting channel 70*d*. The present disclosure, however, is not limited to this. It is allowable that the radius of curvature of either one of the outer edge e1 of the second flow channel 71*b* of the second supply connecting channel 72 and the outer edge e2 of the second return connecting channel 71*d* is made to be greater than the radius of curvature of the outer edge e3 of the first flow channel 70*b* of the first supply connecting channel 73 and the radius of curvature of the outer edge e4 of the first return connecting channel 70*d*.

What is claimed is:

1. A liquid discharge head comprising:

a plurality of first individual channels, each of the first individual channels including a first nozzle;

a first supply manifold connected to the plurality of first individual channels and configured to supply a liquid to the plurality of first individual channels;

a first return manifold connected to the plurality of first individual channels and configured to cause the liquid not discharged from the first nozzle to flow therein;

a plurality of second individual channels, each of the second individual channels including a second nozzle;

a second supply manifold connected to the plurality of second individual channels and configured to supply the liquid to the plurality of second individual channels;

a second return manifold connected to the plurality of second individual channels and configured to cause the liquid not discharged from the second nozzle to flow therein; and a first bypass channel connecting the first supply manifold and the second return manifold, wherein the first bypass channel includes: a first supply connecting channel connected to the first supply manifold; a first return connecting channel connected to the second return manifold; and a first connecting channel communicating the first supply connecting channel and the first return connecting channel, and wherein channel resistance in one of the first supply connecting channel and the first return connecting channel is greater than channel resistance in the first connecting channel.

2. The liquid discharge head according to claim 1, further comprising:

a first inlet port configured to cause the liquid to flow therethrough and into the first supply manifold;

a second inlet port configured to cause the liquid to flow therethrough and into the second supply manifold;

a first outlet port configured to cause the liquid to flow therefrom and out from the first return manifold;

a second outlet port configured to cause the liquid to flow therefrom and out from the second return manifold; and a second bypass channel connecting the second supply manifold and the first return manifold, wherein the first supply manifold, the second supply manifold, the first return manifold and the second return manifold extend in a first direction, wherein the first inlet port, the second inlet port, the first outlet port and the second outlet port are arranged on a side of one end in the first direction, and wherein the second bypass channel is arranged on a side closer to the one end in the first direction than the first bypass channel, and channel resistance in the second bypass channel is greater than channel resistance in the first bypass channel.

3. The liquid discharge head according to claim 2, wherein the second bypass channel includes: a second supply connecting channel connected to the second supply manifold; a second return connecting channel connected to the first return manifold; and a second connecting channel communicating the second supply connecting channel and the second return connecting channel, and wherein a cross-sectional area of one of the first supply connecting channel and the first return connecting channel is greater than a cross-sectional area of the second supply connecting channel and a cross-sectional area of the second return connecting channel.

4. The liquid discharge head according to claim 3, wherein the first connecting channel of the first bypass channel and the second connecting channel of the second bypass channel have a cylindrical shape.

5. The liquid discharge head according to claim 3, wherein a hole diameter of the second connecting channel of the second bypass channel is smaller than a hole diameter of the first connecting channel of the first bypass channel.

6. The liquid discharge head according to claim 3, wherein a radius of curvature of an outer edge of one of the second supply connecting channel and the second return connecting channel is greater than a radius of curvature of an outer edge of the first supply connecting channel and a radius of curvature of an outer edge of the first return connecting channel.

7. The liquid discharge head according to claim 3, wherein a radius of curvature of an outer edge of one of the first supply connecting channel and the first return connecting channel is smaller than a radius of curvature of an outer edge of the second supply connecting channel and a radius of curvature of an outer edge the second return connecting channel.

8. The liquid discharge head according to claim 3, wherein a radius of curvature of an outer edge of the first supply connecting channel is greater than a radius of curvature of an outer edge of the first return connecting channel, and wherein a radius of curvature of an outer edge of the second supply connecting channel is greater than a radius of curvature of an outer edge the second return connecting channel.

9. The liquid discharge head according to claim 3, wherein the first supply manifold is arranged at a location above the first return manifold, wherein the second supply manifold is arranged at a location above the second return manifold;

wherein compliance of the first supply connecting channel is greater than compliance of the first return connecting channel, and wherein compliance of the second supply connecting channel is greater than compliance of the second return connecting channel.

10. A liquid discharge head comprising:

a supply manifold configured to cause a liquid to be supplied thereto from outside;

a return manifold configured to cause the liquid to be exhausted therefrom to the outside;

a plurality of individual channels, each of the individual channels including an upstream end connected to the supply manifold and a downstream end connected to the return manifold, and each of the individual channels communicating individually with one of a plurality of nozzles arranged in a row on a nozzle surface; and a bypass channel connecting the supply manifold and the return manifold, wherein the bypass channel includes: a supply connecting channel connected to the supply manifold; a return connecting channel connected to the return manifold; and a connecting channel connecting the supply connecting channel and the return connecting channel, and wherein channel resistance in one of the supply connecting channel and the return connecting channel is greater than channel resistance in the connecting channel.

* * * * *